US007289754B2

(12) United States Patent
Miyasaka et al.

(10) Patent No.: US 7,289,754 B2
(45) Date of Patent: Oct. 30, 2007

(54) IMAGE FORMING APPARATUS

(75) Inventors: Yutaka Miyasaka, Machida (JP); Nobuyasu Tamura, Hachioji (JP); Kazutoshi Kobayashi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 42 days.

(21) Appl. No.: 11/182,785

(22) Filed: Jul. 18, 2005

(65) Prior Publication Data

US 2006/0093406 A1 May 4, 2006

(30) Foreign Application Priority Data

Oct. 29, 2004 (JP) ..... 2004-315394

(51) Int. Cl.
*G03G 15/09* (2006.01)

(52) U.S. Cl. ..... 399/267; 399/256; 399/277

(58) Field of Classification Search ..... 399/256, 399/267, 272–277
See application file for complete search history.

(56) References Cited

U.S. PATENT DOCUMENTS 4,721,982 A * 1/1988 Ueda ..... 399/276
4,814,820 A * 3/1989 Hirahara et al. ..... 399/256
5,991,585 A * 11/1999 Nakamura ..... 399/277

FOREIGN PATENT DOCUMENTS

| | | |
|---|---|---|
| JP | 64-021472 | 1/1989 |
| JP | 9-146372 | 6/1997 |
| JP | 10-240010 | 9/1998 |
| JP | 11-219031 | 8/1999 |
| JP | 2001-154471 | 6/2001 |

* cited by examiner

*Primary Examiner*—David M. Gray
*Assistant Examiner*—Laura K Roth
(74) *Attorney, Agent, or Firm*—Finnegan, Henderson, Farabow, Garrett & Dunner, L.L.P.

(57) ABSTRACT

An image forming apparatus incorporating: an image forming body; and a developing unit having a developer carrier, a magnetic field generator, a developer restriction member, a first conveyer, and a second conveyer, wherein the magnetic field generator has: a main magnetic pole; pickup magnetic pole; and a strip-off magnetic pole, wherein the developing unit satisfies following conditions: (a) the second conveyer is a screw conveyer having an outer diameter within 24 mm-30 mm, rotating speed of 300-500 rpm, (b) the pickup magnetic pole is arranged at an angle of 25°-60° downstream with a line connecting a rotation centers of the developer carrier and the second conveyer, (c) the strip-off magnetic pole is arranged at 60°-80° upward with the line,(d) a transporting capability of the first conveyer is larger than that of the second conveyer.

18 Claims, 5 Drawing Sheets

IMAGE FORMING APPARATUS

This application is based on Japanese Patent Application No. 2004-315394 filed on Oct. 29, 2004, in Japanese Patent Office, the entire content of which is hereby incorporated by reference.

BACKGROUND OF THE INVENTION

1. Technical Field

The present invention relates to an image forming apparatus utilizing an electrophotographic method, and more particularly to improvements of the developing unit used in the image forming apparatus to form images with an electrophotographic process.

2. Related Art

In the field of electrophotographic image forming apparatus, according to expanded usage from character based image formation to photographic image formation or to color image formation, developing units to form high quality images are becoming required. Namely reproducing image densities from low density to high density regions with high fidelity, and forming solid images with uniform densities and the like, are becoming the required standard of the developing units.

Further, a down-sized developing unit is desired, particularly in a color image forming apparatus since plural developing units are installed in one image forming apparatus, down-sized developing units are required.

In order to fulfill these requirements, improvements of the developing unit are in progress. In order to form high quality images, using a two-component developer containing a toner and a carrier is effective, and many improvements of are achieved for the developing unit using the two-component developer.

The Patent Document 1 discloses a developing unit incorporating: a magnet roll to transport the two-component developer to the position facing to the photosensitive body; two agitation rollers arranged under the magnet roll; and a guide plate to guide the developer falling from the magnet roll onto the agitation rollers.

The Patent Document 2 discloses a developing unit containing two screw conveyers, which transport the developer in opposite directions with each other while agitating it.

The Patent Document 3 discloses a developing unit in which a fixed magnet roll is provided inside a developing sleeve, which transports the developer to the developing area, the magnet roll having two magnetic poles forming a repulsive magnetic field to adhere and strip-off the developer and an auxiliary magnetic pole between the above two magnetic poles.

The Patent Document 4 discloses a developing unit containing a developer carrier to transport the developer into a developing area and a developer transporting member to supply the developer to the developing carrier, wherein the developer transporting member is arranged beneath the developer carrier with an interval within a prescribed distance.

The Patent Document 5 discloses a developing unit containing a developer carrier to transport the two-component developer into the developing area and two screw conveyers, wherein the transporting velocity of the downstream screw conveyer is lower than that of the upstream screw conveyer.

Patent Document 1: Japanese Patent Publication Open to Public Inspection No. SHO 64-21472

Patent Document 2: Japanese Patent Publication Open to Public Inspection No. HEI 10-240010

Patent Document 3: Japanese Patent Publication Open to Public Inspection No. HEI 9-146372

Patent Document 4: Japanese Patent Publication Open to Public Inspection No. HEI 11-219031

Patent Document 5: Japanese Patent Publication Open to Public Inspection No. 2001-154471

In order to form images of high printing area ratio with uniform densities from start to finish of image formation, as well as forming a uniform density image in a single image frame, a single means or a small number of means for producing high quality images, as disclosed in the Patent Documents 1 through 5, are insufficient. And, comprehensive studies are required for a magnetic field generating member arranged in the developer carrier, a conveyer member to supply the developer to the developer carrier, and for arranging constituent elements of the developing unit including these means.

SUMMARY OF THE INVENTION

The object of the present invention is to provide an image forming apparatus having a down-sized developing unit, which can form images with uniform densities, especially uniform density solid images in both the transporting direction and the transporting width direction perpendicular to the transporting direction.

The object is attained mainly by the following embodiments in the present invention.

Incidentally, in the present specification, the terms "upstream" and "downstream" are defined with respect to the rotation direction of the developer carrier, except in cases of specific supplementary explanation. The present invention is performed from the following viewpoints (i)-(iv).

(i) To make the densities in the transporting width direction of the recording member uniform by establishing adequate transporting capability of the conveyer, and by forming a uniform developer layer in the direction of rotation axis of the developer carrier.

When the transporting capability of the second conveyer, which supplies the developer to the developer carrier, is insufficient, the density becomes uneven in the rotation axis direction of the developer carrier as well as the second conveyer, namely in the transporting width direction of the recording member.

By increasing the transporting capability of the second conveyer, which supplies the developer to the developer carrier while transporting the developer in its axial direction, and by setting the transporting capability to an appropriate level, the density is made uniform in the transporting width direction of the recording member.

(ii) To make the densities in the transporting direction of the recording member uniform by appropriately arranging the magnetic pole configuration of the magnetic field generating member, which is provided inside the developer carrier.

The magnetic field generating member forms a repulsive magnetic field to strip-off the developer from the developer carrier downstream of the main magnetic pole, which makes the developer carrier hold the developer in the developing area. The downstream magnetic pole of the two magnetic poles with the same polarity, which form a repulsive magnetic field, has a function of a pickup magnetic pole to make the developer carrier attract the developer.

By arranging the pickup magnetic pole at an appropriate angle, the strip-off of the developer from the developer carrier and the attraction of the developer to the developer carrier can be stably performed, the uniform developer layer can be formed in the rotation direction of, the developer carrier, and the uniform density in the transporting direction of the recording member can be attained.

(iii) In the present invention, a first and a second conveyers are utilized, each of which transports the developer in opposite rotation axis direction. In this case, the amount of developer in the U-turn section may decrease where the developer is transferred from the first conveyer to the second conveyer, and the amount of the developer transferred to the developer carrier may also decrease. The likely result is a problem of uneven density in the transporting width direction and transporting direction of the recording member. As one means to solve this problem, can be a means where the space of the U-turn section in the conveyer rotation axis direction is made large to increase the amount of the developer contained in the section, however in order to downsize the apparatus, the measure to increase the U-turn section area is not preferable.

This developer shortage problem in the U-turn section is likely to result particularly in the measure described in item (1), namely when the second conveyer's transporting capability is increased and when high speed development is conducted by increasing the line velocity of the developer carrier.

In the present invention, by setting the transporting capability of the first conveyer larger than that of the second conveyer, the developer shortage problem in the U-turn section is overcome and the uniform density images are formed in the transporting width and the transporting direction of the recording member.

(iv) Further in the present invention, by arranging the rotation axis of the second conveyer slanted such that the upstream side of the second conveyer transporting direction is positioned lower than the downstream side, the developer shortage problem at the U-turn section is overcome to form uniform density images in the width direction of the recording member with a relatively small amount of developer.

Specifically, the object of the present invention is achieved by an image forming apparatus including:

an image-forming body;

a latent image forming section to form an electrostatic latent image on the image forming body; and a developing unit to form a toner image by developing the electrostatic latent image, wherein the developing unit has:

a developer carrier, arranged to face the image forming body, for transporting developer to a developing area, and for forming a developer layer in the developing area by rotation of the developer carrier;

a magnetic field generating member arranged inside the developer carrier;

a restriction member to restrict an amount of the developer to be transported by the developer carrier;

a first conveyer to agitate the developer while transporting the developer in a rotation axis direction of the first conveyer; and a second conveyer to receive the developer transported by the first conveyer, and to supply the developer to the developer carrier while transporting the developer in a rotation axis direction of the second conveyer, wherein the magnetic field generating member has:

a main magnetic pole for generating a magnetic field to form the developer layer on the developer carrier in the developing area;

a pickup magnetic pole to hold the developer from the second conveyer onto the developer carrier; and a strip-off magnetic pole to strip off the developer having passed through the developing area from the developer carrier, wherein the developing unit satisfies following conditions of a, b, c, and d:

a: the second conveyer is a screw conveyer having an outer diameter of not less than 24 mm and not more than 30 mm, which rotates with a rotating speed of not less than 300 rpm (revolutions per minute) and not more than 500 rpm, b: the pickup magnetic pole is arranged at an angle of not less than 25° and not more than 60° downstream with respect to a line connecting a rotation center of the developer carrier and a rotation center of the second conveyer, c: the strip-off magnetic pole is arranged at an angle of not less than 60° and not more than 80° upstream with respect to the line, d: a transporting capability of the first conveyer is larger than a transporting capability of the second conveyer.

BRIEF DESCRIPTION OF THE DRAWINGS

Embodiments will now be described, by way of example only, with reference to the accompanying drawings which are meant to be exemplary, not limiting, and wherein like elements are numbered alike in several figures, in which.

DETAILED DESCRIPTION OF THE PREFERRED EMBODIMENT

Embodiment 1

Figure 1:
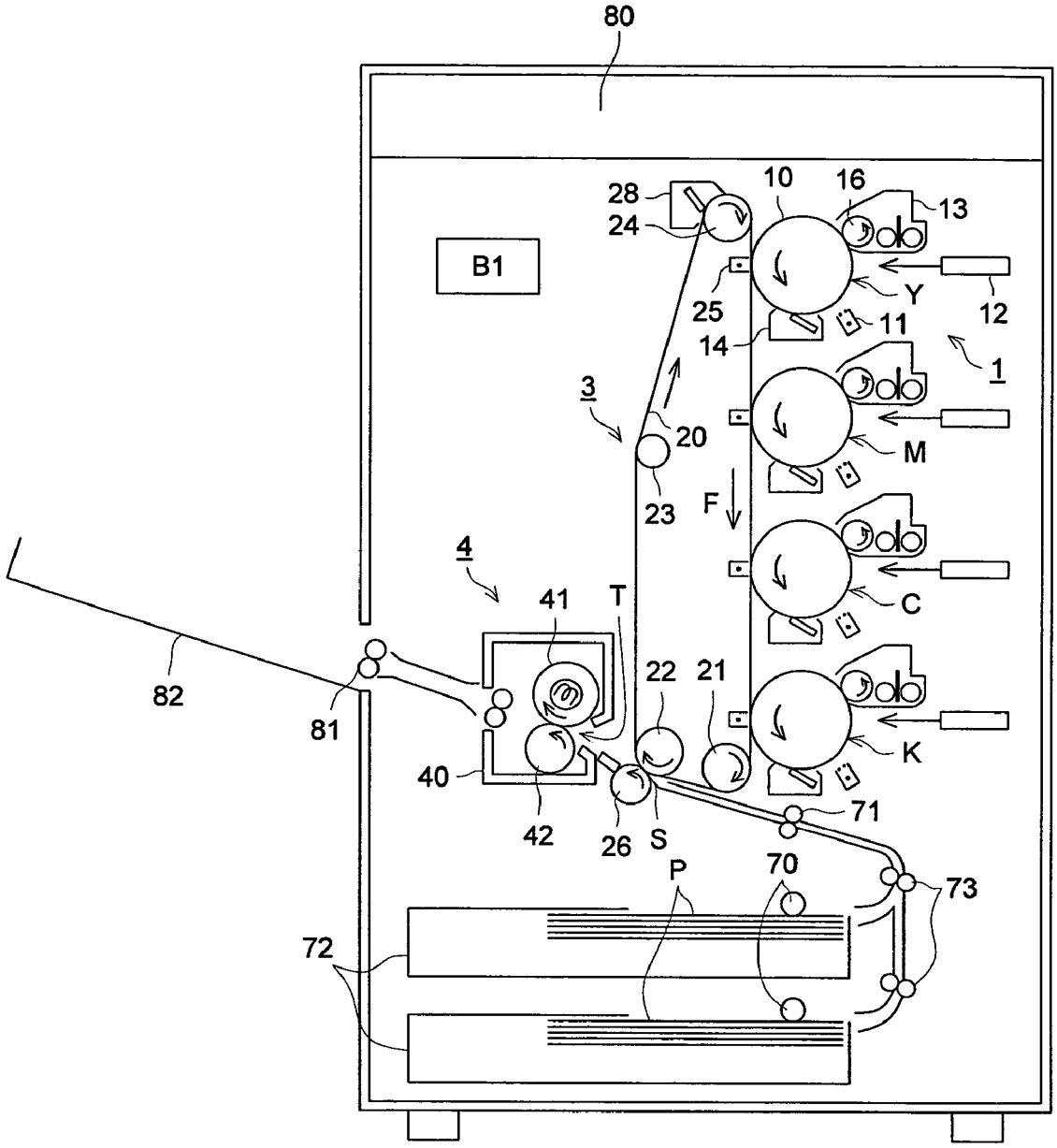
FIG. 1 is a schematic diagram showing an example of the overall structure of image forming apparatus relating to the embodiment of the present invention.

FIG. 1 is a schematic diagram showing an example of the overall structure of an image forming apparatus relating to the embodiment of the present invention.

In FIG. 1, 10 shows a photosensitive body as an image forming body, 11 shows a charger, 12 shows an exposing unit, 13 shows a developing unit, 14 shows a cleaning unit to clean the surface of the photosensitive body 10, 16 shows a developing sleeve as the developer carrier structuring the developing unit 13, and 20 shows an intermediate transfer belt. The image forming means 1 comprises the photosensitive body 10, the charger 11, the developing unit 13, and the cleaning unit 14. Since the image forming means for each color image has the same mechanical structure, in FIG. 1 reference numbers are given only to the structure of the Y (yellow) series. Reference numbers of the structural elements of M (magenta), C (cyan), and K (black) are omitted.

The charger 11 and the exposure unit 12 structure a latent image forming section to form electrostatic latent images on the image forming body.

Each color image forming means 1, is arranged in the order of Y, M, C, K with respect to the moving direction of the intermediate transfer belt 20. Each photosensitive body 10 contacts the surface of the entrained intermediate transfer belt 20, and rotates in the same direction as the running direction of the intermediate belt and at the same linear velocity as the belt at the point of contact.

The intermediate transfer belt 20 is entrained around the drive roller 21, the grounded roller 22, the tension roller 23, and the driven roller 24. These rollers, the intermediate transfer belt 20, transfer unit 25, and the cleaning unit 28, etc. construct the belt unit 3.

The intermediate transfer belt 20 is moved by the rotation of the drive roller 21 driven by a drive motor (not illustrated).

The photosensitive body 10 is structured by forming a electro-conductive layer and a photosensitive layer such as an a—Si layer or an OPC layer on the circumferential surface of a cylindrical metallic base body made for example of aluminum, and rotates to the counterclockwise as shown by arrow mark in FIG. 1 with the electro-conductive layer being connected to ground.

Electric signals corresponding to image data from the readout unit 80 or external equipment are converted to light signals by an image forming laser unit, and are exposed imagewise onto the photosensitive body 10 by the exposure unit 12.

The developing unit 13 has the developing sleeve 16 as the developer carrier, which is structured of a cylinder of nonmagnetic stainless steel or aluminum, and rotates to the same direction as the photosensitive body 10 while keeping a prescribed interval from the circumferential surface of the photoconductive body 10. The details of the developing unit 13 relating to the present invention will be described later.

The intermediate transfer belt 20 is an endless belt having the volume resistivity of $10^6$-$10^{12}$ Ω·cm, and is for example a semi-conductive seamless belt with a thickness of 0.015-0.05 mm. The belt material can be made by dispersing electro-conductive material into engineering plastics such as denatured polyimide, thermosetting polyimide, ethylene-tetrafluoroethylene copolymer, polyvinylidene fluoride, and nylon alloy.

The transfer unit 25 has a function to transfer the toner image formed on the photosensitive body 10 onto the intermediate transfer belt 20 by application of a direct current voltage of a polarity opposite to that of the toner. As the transfer unit 25, a transfer roller may be used in addition to a corona discharger.

The transfer unit 26 incorporates a transfer roller being capable of pressure contact to and release from the grounded roller 22, and re-transfers the toner image formed on the intermediate transfer belt 20 onto the recording member P.

The cleaning unit 28, having a cleaning blade, is provided so to face the driven roller 24 sandwiched between which is the intermediate transfer belt 20. After transferring the toner image onto the recording member P, the intermediate transfer belt 20 passes through the cleaning unit 28, and the remaining toner on the circumferential surface of the belt 20 is cleaned off by the cleaning blade.

The notation 70 shows paper feeding rollers, 71 shows timing rollers, 72 shows paper cassettes, and 73 shows paired transportation rollers.

The fixing unit 4 fixes the toner image onto the recording member P, transferred from the intermediate transfer belt 20 by heating/pressing the toner image at the nip portion T formed between the heat roller 41 and the pressure roller 42. The exit roller 81 ejects the fixed recording member to the exit tray 82.

(Developing Unit)

Next, the developing unit 13 will be described.

As for the developing unit 13 a developing unit, which uses two-component developer having main components of a carrier and a toner, is applicable, while a two-component developing unit using small particle toners is preferably applicable. Further, either developing units performing normal development or reversal development can be applicable, however the developing unit performing the reversal development is preferable, where a developing bias voltage of the same polarity as the charging polarity of the photosensitive body 10 is applied onto the developing sleeve 16, and the latent image is developed with the toner charged with the same polarity as the charging polarity of the photosensitive body. In the present embodiment, the reversal development using the negatively charged toner is applied.

As for the small particle sized toner, the toner with volume average particle diameter of 3 μm through 7 μm is preferably used.

The values of volume average particle diameter are particle diameters averaged with volume base, and are measured with such as "COULTER COUNTER TA-II" or "COULTER MULTISIZER" (both are made by Beckman Coulter, Inc.) both equipped with a wet-type dispersion apparatus.

By using these small particle diameter toner, a high quality image having high resolution can be achieved. The toner having the volume average particle diameter of larger than 7 μm degrades the high quality characteristics.

In case of using the toner having the volume average particle diameter of smaller than 3 μm, image degradation due to fogging, etc. is likely to be caused.

As for the above small particle toner, polymerization toner is preferable.

The polymerization toner is the toner in which binder resin formation and toner particle formation is achieved by the polymerization of raw material monomer or polymer of the binder resin followed by the subsequent chemical processing. More specifically the polymerization toner means the toner, which is obtained through suspension polymerization or emulsion polymerization, and if necessary through subsequent fusion processing between particles. Since the polymerization toner is manufactured by the polymerization after the raw monomer or the raw polymer is uniformly dispersed in an aqueous solvent, the toner with uniform particle diameter distribution and uniform particle shape can be obtained.

Specifically, the toner is manufactured by the suspension polymerization method or the method in which fine particles are formed by the emulsion polymerization of the monomer in an aqueous solvent added with emulsified liquid, and subsequently organic solvent or flocculating agent is added for association, which means that plural numbers of resin particles and coloring agent particles fuse with each other. In the association process, there is a method in which the dispersion liquid of a releasing agent or a coloring agent required for the structure of the toner is mixed for association, or a method in which, after the toner constituting elements such as the releasing agent or the coloring agent are dispersed, the emulsion polymerization is performed.

As for magnetic particles of the carrier, metal such as iron, ferrite, magnetite, and alloy of such metal and aluminum, lead etc., which are conventionally known materials can be used. In particular, the ferrite particles are preferable.

Regarding the carrier, magnetic particles covered with a resin coating, or so to speak a resin dispersion type carrier which is formed by dispersing magnetic particles in the resin, are preferable. Components for the resin coating, are not particularly restricted, and resins such as olefin type resin, styrene type resin, styrene-acrylic resin, silicone type resin, ester type resin, or fluorine contained polymer type resin can be used. The resins constituting the resin dispersion type carrier are also not particularly restricted, and conventionally known resin can be used such as styrene-acryl resin, polyester resin, fluorine type resin, and phenol resin. Incidentally, particle diameter of the carrier etc. will be described later. The particle diameter of the carrier is the values measured with the method similar to that for the toner particle diameter.

Figure 2:
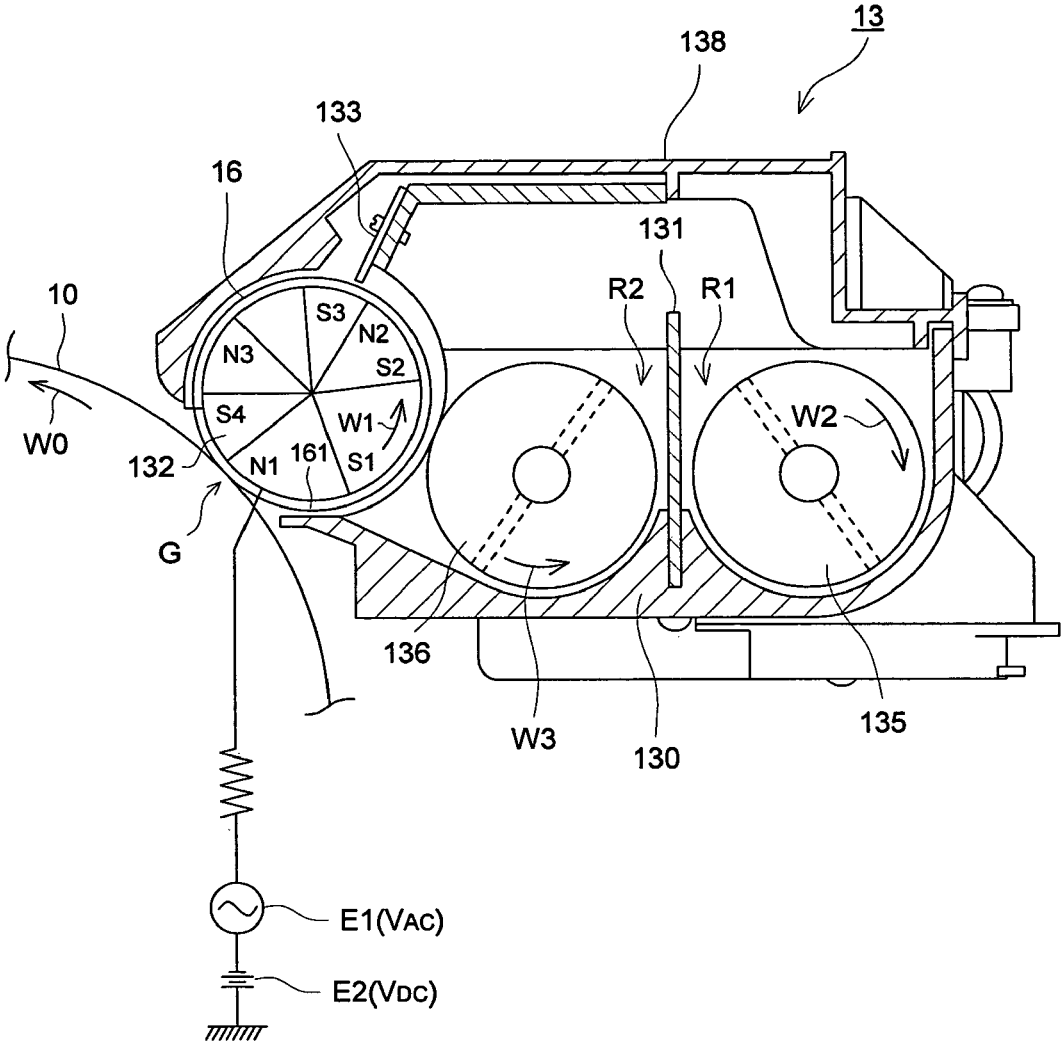
FIG. 2 is an enlarged sectional view of the developing unit in the embodiment 1 of the present invention.

FIG. 2 is an enlarged sectional view of the developing unit 13 in FIG. 1.

Figure 3:
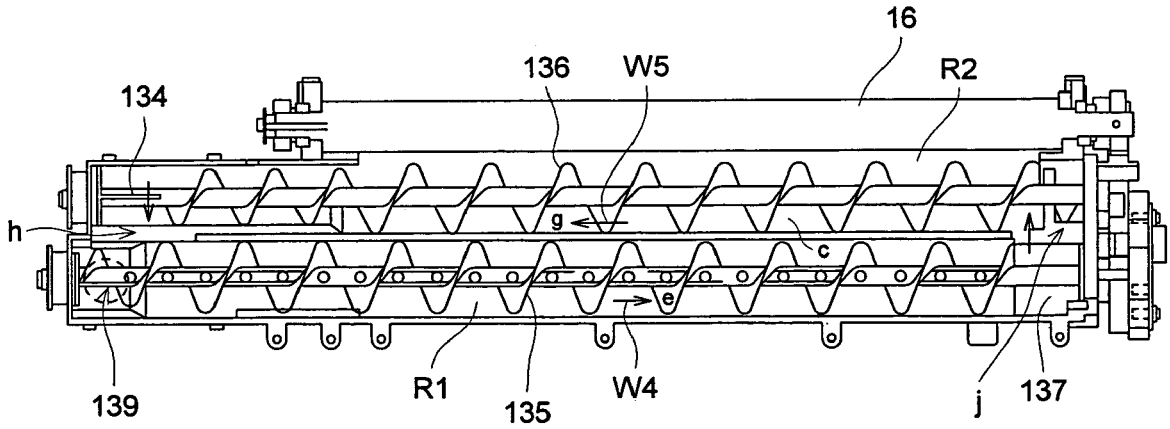
FIG. 3 is a sectional view of the overall developing unit seen from abobe.

FIG. 3 is a sectional view of the overall developing unit 13 seen from above.

In FIG. 2, the notation 130 shows a casing to contain the two-component developer, including toner and carrier. In the developing sleeve 16, the magnet roll 132 is provided as a fixedly provided magnetic field generating member. The magnet roll 132 has three N poles denoted as N1-N3 and four S poles denoted as S1-S4.

N1 is the main magnetic pole to form a magnetic brush of the developer at the developing area G where the developing-sleeve faces to the photosensitive body 10. S1 and S2 are magnetic poles to form a repulsion magnetic field, and by this repulsion field the developer is stripped-off from the developing sleeve 16. The S2 pole is a pickup magnetic pole to adhere the developer onto the developing sleeve16. The developing sleeve 16 rotates to the direction shown by the arrow W1 for transporting the developer. S2, N2, S3, N3, S4, and N1 are magnetic poles arranged successively in the transporting direction and are arranged alternately opposite to form a transporting magnetic pole array. The developer is transported by the transporting magnetic poles and supplied into the developing area. At the position facing the N2 pole, the restriction member 133 is arranged close to the developing sleeve 16, which restricts the amount of the developer transported by the developing sleeve 16 to form a uniform developer layer on the developing sleeve 16.

Notation 135 shows the first screw (screw conveyer) as the first conveyer for agitating and transporting the developer. The first screw 135 rotates in the direction shown by the arrow W2 in FIG. 2, and transports the developer, while agitating it, toward the right direction of the rotation-axes shown by the arrow W4 in FIG. 3. Notation 136 shows the second screw (screw conveyer) as the second conveyer, which rotates in the direction shown by the arrow W3 in FIG. 2, and transports the developer, while agitating it, toward the left direction of the rotation axes shown by the arrow W5 in FIG. 3.

The toner is supplied into the developing unit 13 through the opening 139 shown by a dotted line in FIG. 3 (the opening is provided at the upper cover 138 of the housing 130 in FIG. 2), and is mixed with the developer in the process of transporting it in the W4 direction in FIG. 3.

The agitation room R1 housing the first screw 135 and the supply/reception room R2 housing the second screw 136 are separated by the separator 131, and provided in the separator 131 are the through openings j and h for passage of the developer.

In the housing 130, an opening is arranged at the portion where the developing sleeve 16 faces the photosensitive body 10, and this forms the developing area G.

The development is performed as follows.

In FIG. 2, the photosensitive body 10, the developing sleeve 16, the first screw 135, and the second screw 136 rotate respectively in the directions shown as W0, W1, W2, and W3, and the developer is transported from the first screw 135, to the second screw 136, to the developing sleeve 16, and at the developing area G the development is performed. Herein, to the developing sleeve 16 a developing bias voltage is applied, which is generated by superposing a direct current on an alternate current by the power sources E1 and E2.

The developer contains the toner charged with the same polarity as that of the photosensitive body, and as for the developing bias, a bias voltage having a direct current component of the same polarity as the photosensitive body 10 is applied.

The developer, having passed through the developing area G, is stripped from the developing sleeve 16 by the action of the repulsion magnetic field, formed by the strip-off magnetic pole S1 and the pickup magnetic pole S2, and the stripped developer is transported by the second screw 136 and returns to the first screw 135.

The developer flow in the developing process will be further described by using FIG. 3.

The developer in the agitation room R1 is transported to the right direction as shown by the arrow W4, and supplied to the supply/reception room R2 through the developer passage opening j. In the supply/reception room R2, the developer is transported to the left direction as shown by the arrow W5, and supplied to the developing sleeve 16 in the process of transportation.

As described above, the developer, after performing the development, is transported from the developing sleeve 16 to the second screw 136, whereby the developer transported to the left direction in FIG. 3 by the second screw 136 is supplied through the developer passage opening h into the agitation room R1. In the agitation room R1, the toner corresponding to the amount of toner consumed in the development is supplied through the opening 139, and the supplied toner is mixed uniformly by agitation of the first screw 135.

In high-speed image formation, in order to form uniform density images, it is desirable to rotate the developing sleeve at the linear velocity of at least 350 mm/sec to supply the developer into the developing area G. However, for such high-speed image formation, in order to fulfill the conditions relating to the uniform density and proper gradation reproduction, etc., improvements of the unit construction and of the operating condition, etc. are required. In the following paragraphs these improvements will be described.

(Magnetic Field Generating Member)

Figure 4:
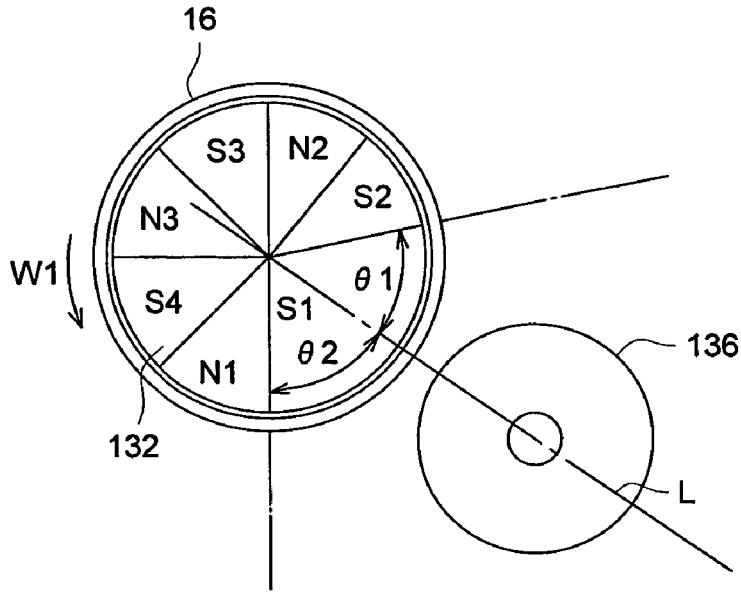
FIG. 4 is a diagram showing an arrangement of the magnetic poles of the magnet roll in the embodiment 1 of the present invention.

Referring to FIG. 4, the magnetic field generating member 132 will be described.

As described above, the magnetic field generating member 132 includes N magnetic poles of N1-N3 and S magnetic poles of S1-S4. By the arrangement where magnetic poles of opposite polarities are arranged alternately, the developer is transported with rotation of the developing sleeve, and by the arrangement where each of neighboring magnetic poles have the same polarity, namely between the strip-off magnetic pole S1 and the pickup magnetic pole S2, the repulsion magnetic field is formed and the developer is stripped-off from the developing sleeve. By this strip-off, the developer, in which toner has been consumed by the development and toner density is decreased, is removed from the developing sleeve 16.

In order to surely conduct the removal of the used developer, and supply of the developer from the second screw 136 to the developing sleeve 16, it is necessary to satisfy the condition b1 that the pickup magnetic pole S2 is arranged at angle θ1 of at least 25° and at most 50° downstream with respect to the line L, which connects the rotation center of the developing sleeve 16 and the rotation center of the second screw 136, and the condition c that the strip-off magnetic pole S1 is arranged at angle θ2 of at least 60° and at most 80° upstream with respect to the line L.

Incidentally, the rotation center of the developing sleeve coincides with the magnetization center of the magnetic field generating member.

As for the condition b1, when the angle θ1 is smaller than 25°, the developer once stripped-off from the developing sleeve 16 is apt to be returned to the developing sleeve 16 by the pickup magnetic pole S2, and since the developer with low toner density is attached to the developing sleeve 16 and transported, the insufficient density image is caused with high probability, especially at the end portion of a single page image. By setting the angle θ1 to at least 25°, this problem is overcome.

On the centrally, when the angle θ1 exceeds 50°, in cases where the fluidity of the developer is decreased, the upper level of the developer, which influences the supply/receipt property of the developer, tends to be lowered, and the amount of developer supply to the developing sleeve 16 decreases to result in uneven pitch (or uneven striped density) in the image.

As for the condition c, when the angle θ2 is smaller than 60°, the developer once stripped-off from the developing sleeve 16 is easily returned to the developing sleeve 16 by the pickup magnetic pole S2, and since the developer with low toner density is attached to the developing sleeve 16 and transported, insufficient density is caused with high probability, especially at the latter portion of a single page image. However by setting the angle θ2 to at least 60°, this problem is overcome.

When the angle θ2 exceeds 80°, it becomes difficult to transport the developer to the supply/reception room R2, and the developer tends to flow backward to the upstream of the rotation direction of the developing sleeve 16 and to flow out of the developing unit.

(Transportation of the Developer)

The developer, in which toner has been consumed by the development and thereby toner density has been decreased, needs to be removed from the developing sleeve 16, and sufficient amount of developer with sufficient toner density needs to be supplied from the second screw 136 to the developing sleeve 16. For this operation, the transporting capability of the second screw 136 must be sufficiently high.

To achieve this, the diameter of the second screw (screw conveyer) 136 is made to be at least 24 mm and at most 30 mm, the pitch is made to be between 30 mm-40 mm, and the rotation speed of the second screw is made to be between 300 rpm-500 rpm (being condition a).

Incidentally, the diameter of the second screw refers to the outer diameter of the screw in the screw conveyer.

When any of the above conditions is less than the lower limit of these ranges, the transporting capability of the second screw 136 becomes insufficient, and insufficient developer density tends to be caused at downstream of the transportation in the rotation axis direction of the second screw 136. Incidentally the upper limits of these ranges are not established for ensuring image quality, but for the limitation for general usage of the apparatus such as size and durability of the apparatus, as well as smooth transporting property.

As described above, the transportation of the developer is conducted with a U-turn transportation, which turns the transporting direction of the developer at the U-turn section around the passage openings j and h located at the end portion. In this U-turn transportation, if the amount of the developer just after the U-turn is insufficient, the developer which is supplied from the upstream side to the downstream side of the second screw 136 becomes insufficient, and uneven amount of the developer is generated in the rotation axis direction of the screw to cause the uneven density in the direction of transporting width.

Consequently the uneven density in the rotation axis direction of the first and second screws, or transporting width direction of the recording member in other words, can be prevented, by setting the transporting capability A of the first screw 135 to be greater than the transporting capability B of the second screw 136, and the ratio of the two transporting capabilities A/B satisfies the relation of $1.04 \leqq A/B \leqq 1.20$ (being condition d1).

By setting the transporting capability A of the first screw 135 relatively large, sufficient amount of the developer is held at the U-turn section, and a uniform amount of the toner is supplied in the axial direction of the second screw 136, and eventually adequate developer is supplied uniformly in the axial direction onto the developing sleeve 16.

The ratio of the transporting capability of the first and the second screws A/B is preferably $1.07 \leqq A/B \leqq 1.20$.

When the ratio A/B is less than 1.04, unevenness with insufficient image density is likely to be generated at the upstream side of the second screw conveyer, namely at the right end portion in FIG. 3. On the other hand when the ratio A/B is greater than 1.20, the problem is likely to be generated that stress on the developer becomes heavy due to packing or clogging of the developer at the downstream portion of the screw conveyer 135.

Figure 5:
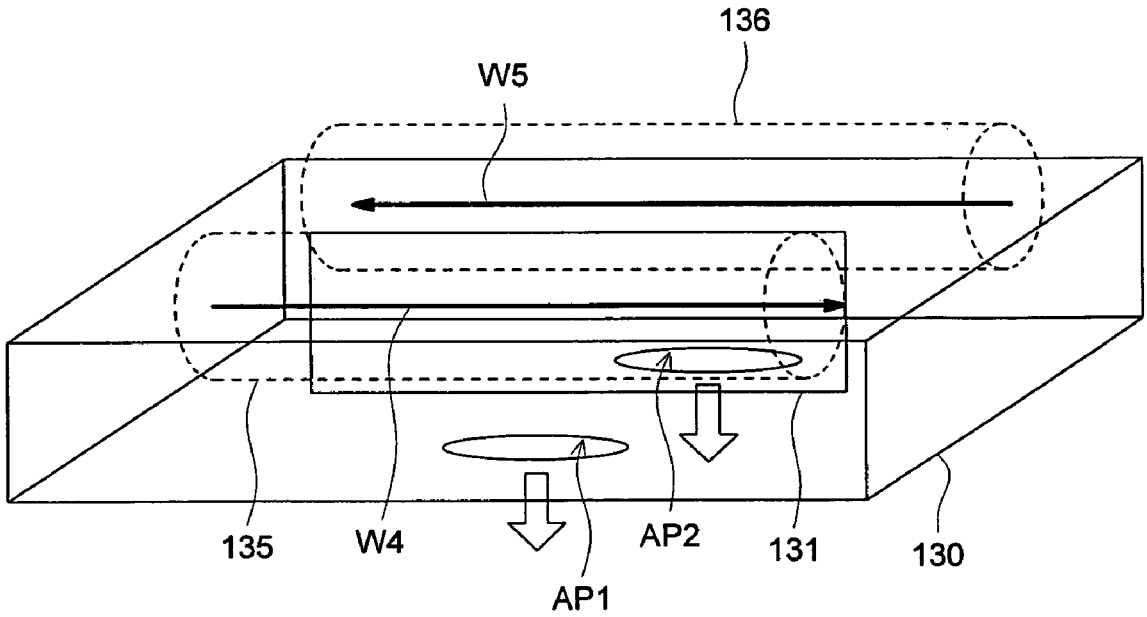
FIG. 5 is a drawing showing the measurement apparatus of transporting capability of the two conveyers.

The apparatus shown in FIG. 5 was used to measure the transporting capability.

FIG. 5 is a schematic diagram of the measuring apparatus made by restructing the developing unit shown in FIG. 2 and FIG. 3.

Namely, the housing 130, the separator 131, the first screw 135, and the second screw 136 are the same as those shown in FIG. 2. As described above, by rotating the first and the second screws 135, 136 the developer flow as shown by the arrows W4, W5 are generated.

The opening AP1 is formed at the bottom portion of the agitation room R1 in the housing 130, and the opening AP2 is formed at the bottom portion of the supply/reception room. The opening AP1 and AP2 are required to have the same shape and same dimensions, for example, circular openings with the same diameter. They may be openings with proper diameter of about several mm and with proper shape, for measuring the relative transporting capability of the first screw 135 and the second screw 136.

In the first step, the first and the second screws 135 and 136 are rotated for 5 minutes with the openings AP1 and AP2 being closed.

Next, in the second step, the first and the second screws 135, 136 are rotated with the opening AP1 open and AP2 closed. The developer amount, which is dropped through the opening AP1 during 10 sec., being between 5 sec. and 15 sec. after the start of the second step, is defined as the transporting capability of the first screw 135.

Similarly to the first and the second step described above, the first and the second screws 135 and 136 are rotated with the opening AP1 closed and AP2 open. The developer amount, which is dropped through the opening AP2 during 10 sec. of the same timing, is defined as the transporting capability of the second screw 136.

Embodiment 2

Figure 6:
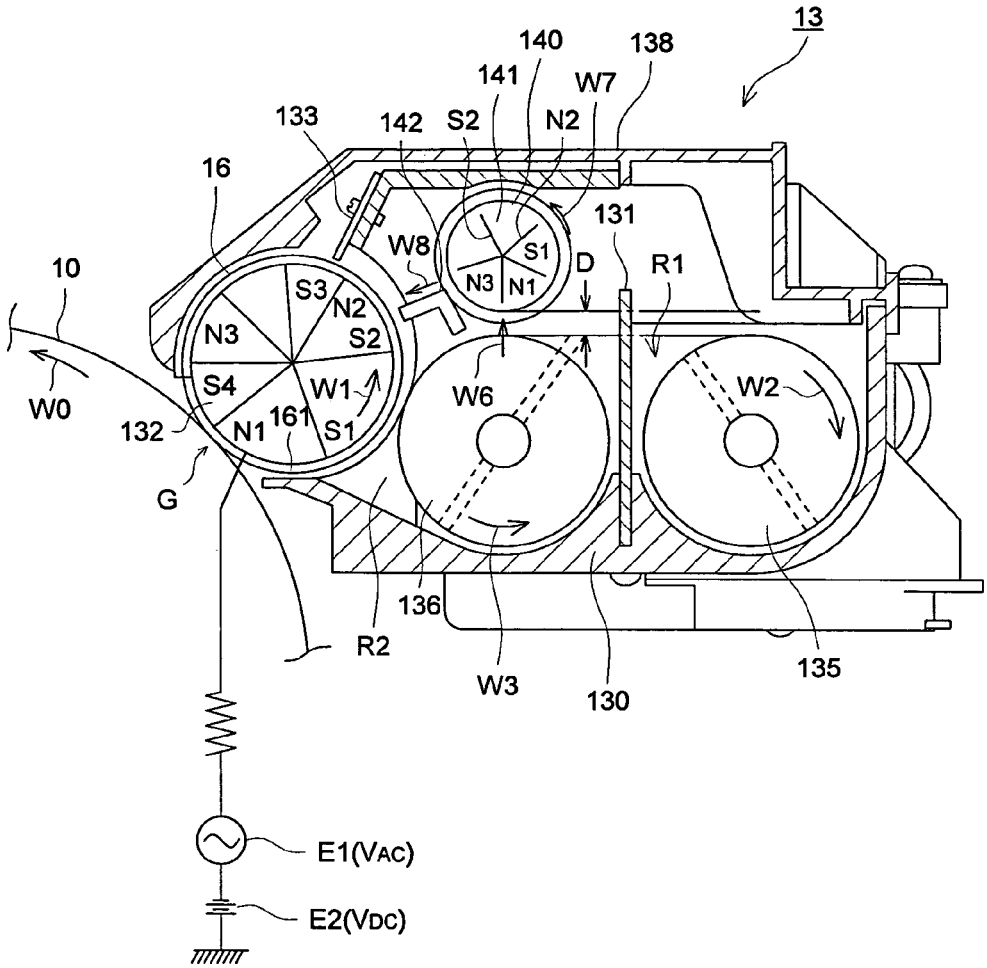
FIG. 6 is a sectional view of the developing unit in the embodiment 2 of the present invention.

The present embodiment has the overall structure shown in FIG. 1, and equipped with the developing unit shown in FIG. 6.

In FIG. 6, the same notations are provided to the same parts as those in FIG. 2, therefore the explanations about these parts will be omitted.

The supply sleeve 140 is a developer carrier for supply, which supplies the developer to the developing sleeve 16 by rotating in the direction shown by the arrow mark W7. The magnet roll 141 is a magnetic field generating member for supply, which is arranged inside the supply sleeve 140 and generates a magnetic field to hold the developer on the supply sleeve 140. Notation 142 shows the guide plate to guide the developer from the supply sleeve 140 to the developing sleeve 16. The supply member to supply the developer to the developing sleeve includes the supply sleeve 140 and the magnet roll 141.

By the rotation of the second screw 136 in the W3 direction, the developer is moved upward as shown by the arrow W6 and transferred onto the supply sleeve 16.

The developer is transported by the supply sleeve 140 rotating counterclockwise, and is guided by the guide plate 142 as shown by the arrow W8 to be supplied onto the developing sleeve 16.

After performing development the developer is moved to the second screw 136, and further as described above, returns to the first screw 135.

Also in this Embodiment 2, the conditions a, c, and d1 of the Embodiment 1 are satisfied for the developing unit 13, but in the Embodiment 2, the angle of the pickup magnetic pole S2 of the magnetic roller 132 is arranged from 40° through 65° downstream, with respect to the line L in FIG. 4 (being condition b2).

Figure 7:
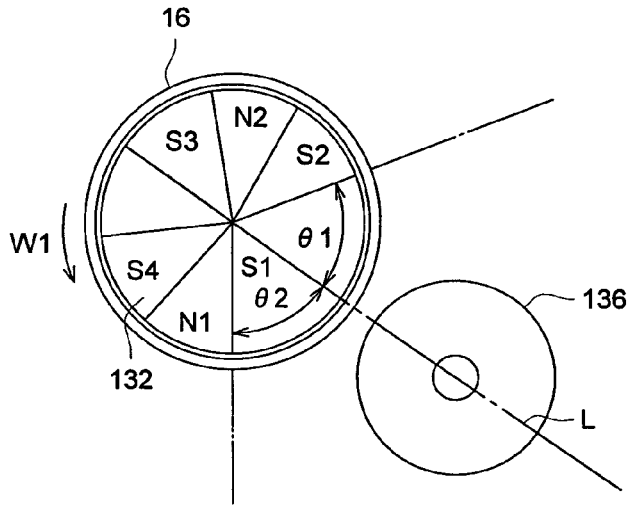
FIG. 7 is a diagram showing the arrangement of magnetic poles of the magnet roll in the embodiment 2 of the present invention.

The magnetic pole arrangement of the Embodiment 2 is shown in FIG. 7. In that embodiment, the angle θ1 of the pickup magnetic pole S2 is arranged from 40° through 65° with respect to the line L (condition b2). The condition b2 is established in order to stably form a developer layer by picking up the developer, supplied from the supply member arranged above the second screw 136 and the developing sleeve 16, onto the developing sleeve 16.

The supply sleeve 140 is arranged above the second screw 136, and the vertical distance D between the supply sleeve 140 and the second screw 136 is structured to be 1.5 mm through 4.0 mm (being condition e). The distance D is the interval between a horizontal line drawn from the top of the second screw 136 and a horizontal line drawn from the bottom of the supply sleeve 140. By satisfying this condition e, the developer is stably transferred from the second screw 136 to the supply sleeve 140 to perform uniform development.

The distance D is the interval in vertical direction between the peripheral surface of the supply sleeve 140 and the peripheral surface of the second screw 136. The first and the second screws may bend to the vertical direction to their rotation axes, by receiving forces due to friction with the developer during rotation. When the D is less than 1.5 mm, the second screw 136 is likely to contact the supply screw 136.

When the distance D is greater than 40 mm, the developer transfer from the second screw 136 to the supply sleeve 140 becomes unstable to cause uneven density images.

Embodiment 3

Figure 8:
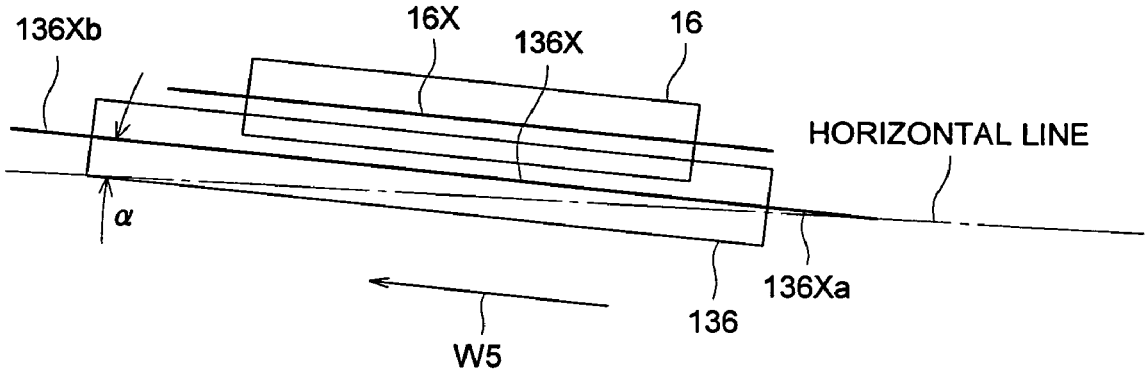
FIG. 8 is a schematic diagram of the developing unit in the embodiment 3 of the present invention.

FIG. 8 is a schematic diagram of the developing unit as seen from right side in FIG. 2.

Notation 16X shows the rotation axis of the developing sleeve 16, and 136X shows the rotation axis of the second screw 136. Further, 136X*a* shows the upstream side of the transporting direction W5 of the second screw 136, while 136X*b* shows the downstream side of W5.

As shown in FIG. 8, the rotation axis of the second conveyer 136 have an angle α at least 0.25° and at most 1.00° with respect to the horizontal line such that the downstream side 136X*b* of the second conveyer transporting direction is positioned higher than the other side. Such the arrangement of the second screw 136 is realized by slanting the whole developing unit 13 by α degree, but only the first and the second screws 135, 136 may be slanted.

By such a slanted arrangement of the second screw 136, uniform density images can be formed in the rotation axis direction of the second screw 136 (or the transporting width direction of the recording member) and in the transporting direction of the recording member.

EXAMPLE OF THE EMBODIMENT

By using the developing unit shown in FIGS. 2 and 3, the following common conditions were set up.

Photosensitive body: negative charging OPC photoconductor,

Charging potential of the photosensitive body: −700 V,

White background potential: −80 V,

Magnetic field generating member: As will be described below, the angles of the pickup magnetic pole S2 and the strip-off magnetic pole S1 were set with various values to conduct experiments. At that time, the angles of the other magnetic poles are set corresponding to the angles of the pickup magnetic pole S2 and the strip-off magnetic pole S1. Table 1 shows representative angles for each magnetic pole.

TABLE 1

| Magnetic pole | Angle (°) | Magnetic flux density (mT) |
|---|---|---|
| N1 | 0.0 | >130 |
| S1 | 55 ± 2 | 100.0 |
| S2 | 145 ± 2 | 50 ± 3 |
| N2 | 195 ± 3 | 50 ± 3 |
| S3 | 245 ± 3 | 60.0 |
| N3 | 280 ± 3 | 85.0 |
| S4 | 315.0 | >100 |

First screw 135: diameter 27 mm, pitch 35 mm, rotation speed 428 rpm,

Second screw 136: diameter 27 mm, pitch 35 mm, rotation speed 400 rpm,

Developing bias: direct current component −500V, alternate current component (p-p) 1.0 kV, frequency of alternate current component 5 kHz, Toner: non-magnetic toner with a volume average diameter of 6.5 μm, Carrier: magnetic carrier with a volume average diameter of 33 μm, Bulk density of developer: 1.6 g/cm$^3$, Linear velocity of the developing sleeve 16: 300 mm/sec.

For each example, which will be explained later, image evaluation has been conducted with following criteria.

A: good result,

B: result with a little problem, and allowable in practical use, namely, difference in transmission density is at most 0.005, C: bad result and not allowable.

Example 1

The diameter of the second screw was varied as shown in Table 2, and other conditions were set with the common conditions.

As shown in Table 2, when the diameter of the second screw 136 is less than 24 mm, due to the insufficient transporting capability of the second screw 136, insufficient density was generated at the end portion of the image in the screw axis direction.

TABLE 2

| Diameter of second screw (mm) | Density uniformity in screw axis direction |
|---|---|
| 20 | C |
| 24 | B |
| 27 | A |
| 30 | A |

Example 2

Pitch of the second screw 136 was varied as shown in Table 3, diameter of the second screw was set as 24 mm (24ϕ) and 30 mm (30ϕ), and other conditions were set with the common conditions to form images.

As shown in Table 3, when the diameter of the second screw 136 was less than 30 mm, due to the insufficient transporting capability of the second screw 136, insufficient density was generated at the rear end portion of the image in the screw axis direction.

TABLE 3

| Pitch of second screw (mm) | Density uniformity in screw axis direction | (24ϕ) | (30ϕ) |
|---|---|---|---|
| 26 | C | C | B |
| 30 | B | B | A |
| 34 | A | A | A |
| 40 | — | — | A |

Example 3

Rotation speed of the second screw 136 was varied as shown in Table 4, and other conditions were set with the common conditions to form images.

As shown in Table 4, when the rotation speed of the second screw 136 is lower than 300 rpm, due to the insufficient transporting capability of the second screw 136, insufficient density was generated at the rear end portion of the image in the screw axis direction.

TABLE 4

| Rotation speed of second screw (rpm) | Density uniformity in screw axis direction |
|---|---|
| 200 | C |
| 300 | B |
| 400 | A |
| 500 | A |

Example 4

The angle θ1 of the pickup magnetic pole S2 with respect to the line L in FIG. 4 was varied as shown in Table 5, and other conditions were set with common conditions to form images. Uneven pitch (uneven density with pitch) of image was evaluated with the following criteria.

A: Uneven pitch was not observed.

B: A few uneven pitches were observed, but allowable in practical use.

C: Unacceptable.

As shown in Table 5, when the angle θ1 is less than 25° density was decreased at the rear end portion of a single page of image, while when the angle θ1 exceeds 45° uneven pitch was generated in the image. The uneven pitch is a phenomenon that uneven densities are generated in the image corresponding to the pitch of the second screw 136.

TABLE 5

| Angle θ1 of pickup pole with respect to line L | Density uniformity at rear end portion of solid image | Uneven pitch |
|---|---|---|
| 15° | C | A |
| 25° | B | A |
| 30° | A | A |
| 35° | A | A |
| 40° | A | A |
| 45° | A | B |
| 50° | A | C |

Example 5

The angle θ2 of the strip-off magnetic pole S1 with respect to the line L in FIG. 4 was varied as shown in following Table 6, and other conditions were set with common conditions to form images.

As shown in Table 6, when the angle θ2 was less than 60°, density was decreased at the rear end portion of a single page of image, while when the angle θ2 exceeded the upper limit of 80° flowing-out of the developer was caused.

TABLE 6

| Angle θ2 of strip-off pole with respect to line L | Density uniformity at rear end portion of solid image |
|---|---|
| 55° | C |
| 60° | B |
| 65° | A |
| 70° | A |
| 75° | B |
| 80° | B |

Example 6

The ratio of the transporting capability of the first screw 135 to the transporting capability of the second screw 136 A/B was varied as shown in following Table 7 to form images for evaluation.

As the result, as shown in Table 7, when the ratio A/B was less than 1.04, the image density was decreased at the image portion corresponding to the upstream side of the second screw 136, and degradation of the solid image uniformity was observed. Further, when the ratio A/B exceeded 1.20, density differences were observed among images. Incidentally, the "following-ability during continuous solid image copies" indicates the evaluation item regarding density difference among copies made with continuous copying mode.

The evaluation criteria of this item were as follows.

A: The density difference was hardly observed.

B: The density difference was observed, but the image was in allowable level for practical use.

C: Unacceptable level of density difference was observed.

D: Excessive density difference was observed.

TABLE 7

| A/B | Uniformity of solid image | Following-ability during continuous solid image copies |
|---|---|---|
| 1.35 | A | B |
| 1.20 | A | A |
| 1.10 | A | A |
| 1.07 | A | A |
| 1.04 | A | AB |
| 1.00 | A | B |
| 0.95 | C | C |
| 0.90 | C | D |

Example 7

The developing unit shown in FIG. 6 was used, and images were formed with the above-described common conditions as well as the condition that the vertical distance D between the second screw 136 and the supply sleeve 140 was varied as shown in following Table 8. And as for the magnet roller for supply, the roller with the magnetic pole arrangement shown in following Table 9 was used.

As the result, as shown in Table 8, when the distance D was 5.0 mm, uneven density due to uneven pitch density was significant in solid images.

When the distance D was 1.0 mm or 1.5 mm, good image density result was obtained.

However, when the distance D was less than 1.5 mm, the second screw 136 has the possibility to contact the supply screw 140 when the second screw bents during rotation.

TABLE 8

| Distance D (mm) | Uniformity of solid image |
|---|---|
| 1.0 | A |
| 1.5 | A |
| 2.5 | A |
| 4.0 | B |
| 5.0 | C |

TABLE 9

| Magnetic pole | Angle (°) | Flux density (mT) |
|---|---|---|
| N1 | 20 | 80 ± 5 |
| S1 | 60 ± 2 | 60 ± 5 |
| N2 | 120 ± 2 | 50 ± 5 |
| S2 | 180 ± 2 | 60 ± 5 |
| N3 | 220 ± 2 | 25 ± 5 |

Example 8

The angle α of the rotation axis of the second screw 136 with respect to the horizontal line was varied as shown in Table 10 to form images for evaluation. The "following-ability during continuous solid image copies" in Table 10 is the same criterion as that of Table 7.

As the result, when the angle α was less than 0.25°, problems were observed in the uniformity of solid image and in the following-ability during continuous solid image copies, but when a was not less than 0.25° good images were formed.

TABLE 10

| Angle α | Uniformity of solid image | Following-ability during continuous solid image copies |
|---|---|---|
| +1.25 | B | AB |
| +1.00 | AB | A |
| +0.75 | A | A |
| +0.50 | A | A |
| +0.25 | A | AB |
| ±0.00 | A | B |
| −0.25 | B | C |
| −0.50 | C | C |
| −0.75 | C | D |
| −1.00 | D | D |
| −1.25 | D | D |
| −1.50 | D | D |

As can be understood from the above description, the object of the present invention can also be attained by the following embodiments:

(1) An image forming apparatus including: an image forming body; a latent image forming section to form an electrostatic latent image on the image forming body; and a developing unit to form a toner image by developing the electrostatic latent image, wherein the developing unit has: a developer carrier, arranged to face the image forming body, for transporting developer to a developing area and for forming a developer layer in the developing area by rotation of the developer carrier; a magnetic field generating member arranged inside the developer carrier; a restriction member to restrict an amount of the developer to be transported by the developer carrier; a first conveyer to agitate the developer while transporting the developer in a rotation axis direction of the first conveyer; and a second conveyer to receive the developer transported by the first conveyer and to supply the developer to the developer carrier while transporting the developer in a rotation axis direction of the second conveyer, wherein the magnetic field generating member has: a main magnetic pole for generating a magnetic field to form the developer layer on the developer carrier in the developing area; a pickup magnetic pole to hold the developer from the second conveyer onto the developer carrier; and a strip-off magnetic pole to strip off the developer having passed through the developing area from the developer carrier, wherein the developing unit satisfies following conditions of a, b1, c, and d1:

a: the second conveyer is a screw conveyer having an outer diameter of not less than 24 mm and not more than 30 mm, which rotates with a rotating speed of not less than 300 rpm (revolutions per minute) and not more than 500 rpm, b1: the pickup magnetic pole is arranged at an angle of not less than 25° and not more than 50° downstream with respect to a line connecting a rotation center of the developer carrier and a rotation center of the second conveyer, c: the strip-off magnetic pole is arranged at an angle of not less than 60° and not more than 80° upward with respect to the line, d1: a ratio A/B is not less than 1.04 and not greater than 1.20 when the transporting capability of the first conveyer is A and the transporting capability of the second conveyer is B.

(2) An image forming apparatus including: an image forming body; a latent image forming section to form an electrostatic latent image on the image forming body; and a developing unit to form a toner image by developing the electrostatic latent image, wherein the developing unit has: a developer carrier, arranged to face the image forming body, for transporting developer to a developing area and for forming a developer layer in the developing area by rotation of the developer carrier; a magnetic field generating member arranged inside the developer carrier; a restriction member to restrict an amount of the developer to be transported by the developer carrier; a first conveyer to agitate the developer while transporting the developer in a rotation axis direction of the first conveyer; a second conveyer to receive the developer transported by the first conveyer and to transport the developer in a rotation axis direction of the second conveyer; and a supply member which receives the developer transported by the second conveyer and supplies the developer to the developer carrier by the rotation of the supply member, wherein the magnetic field generating member has: a main magnetic pole for generating a magnetic field to form the developer layer on the developer carrier in the developing area; a pickup magnetic pole to hold the developer from the second conveyer onto the developer carrier; and a strip-off magnetic pole to strip off the developer having passed through the developing area from the developer carrier, wherein the developing unit satisfies following conditions of a, b2, c, d1, and e:

a: the second conveyer is a screw conveyer having an outer diameter of not less than 24 mm and not more than 30 mm, which rotates with a rotating speed of not less than 300 rpm (revolutions per minute) and not more than 500 rpm, b2: the pickup magnetic pole is arranged at an angle of not less than 40° and not more than 60° downstream with respect to a line connecting a rotation center of the developer carrier and a rotation center of the second conveyer, c: the strip-off magnetic pole is arranged at an angle of not less than 60° and not more than 80° upstream with respect to the line, d1: a ratio A/B is not less than 1.04 and not greater than 1.20 when the transporting capability of the first conveyer is A and the transporting capability of the second conveyer is B, e: the supply member is arranged above the second conveyer with a vertical distance not less than 1.5 mm and not more than 4;0 mm.

(3) An image forming apparatus including: an image forming body; a latent image forming section to form an electrostatic latent image on the image forming body; and a developing unit to form a toner image by developing the electrostatic latent image, wherein the developing unit has: a developer carrier, arranged to face the image forming body, for transporting developer to a developing area and for forming a developer layer in the developing area by rotation of the developer carrier; a magnetic field generating member arranged inside the developer carrier; a restriction member to restrict an amount of the developer to be transported by the developer carrier; a first conveyer to agitate the developer while transporting the developer in a rotation axis direction of the first conveyer; and a second conveyer to receive the developer transported by the first conveyer and to supply the developer to the developer carrier while transporting the developer in a rotation axis direction of the second conveyer, wherein the magnetic field generating member has: a main magnetic pole for generating a magnetic field to form the developer layer on the developer carrier in the developing area; a pickup magnetic pole to hold the developer from the second conveyer onto the developer carrier; and a strip-off magnetic pole to strip off the developer having passed through the developing area from the developer carrier, wherein the developing unit satisfies following conditions of a, b1, c, and f:

a: the second conveyer is a screw conveyer having an outer diameter of not less than 24 mm and not more than 30 mm, which rotates with a rotating speed of not less than 300 rpm (revolutions per minute) and not more than 500 rpm, b1: the pickup magnetic pole is arranged at an angle of not less than 25° and not more than 50° downstream with respect to a line connecting a rotation center of the developer carrier and a rotation center of the second conveyer, c: the strip-off magnetic pole is arranged at an angle of not less than 60° and not more than 80° upward with respect to the line, f: each of a rotation axis of the developer carrier, a rotation axis of the second conveyer have an angle $\alpha$ not less than 0.25° and not more than 1.0° with respect to a horizontal line such that a downstream side in the second conveyer transporting direction is positioned higher than the other side.

(4) An image forming apparatus including: an image forming body; a latent image forming section to form an electrostatic latent image on the image forming body; and a developing unit to form a toner image by developing the electrostatic latent image, wherein the developing unit has: a developer carrier, arranged to face the image forming body, for transporting developer to a developing area and for forming a developer layer in the developing area by rotation of the developer carrier; a magnetic field generating member arranged inside the developer carrier; a restriction member to restrict an amount of the developer to be transported by the developer carrier; a first conveyer to agitate the developer while transporting the developer in a rotation axis direction of the first conveyer; a second conveyer to receive the developer transported by the first conveyer and to transport the developer in a rotation axis direction of the second conveyer; and a supply member which receives the developer transported by the second conveyer and supplies the developer to the developer carrier by the rotation of the supply member, wherein the magnetic field generating member has: a main magnetic pole for generating a magnetic field to form the developer layer on the developer carrier in the developing area; a pickup magnetic pole to hold the developer from the second conveyer onto the developer carrier; and a strip-off magnetic pole to strip off the developer having passed through the developing area from the developer carrier, wherein the developing unit satisfies following conditions of a, b2, c, e, and f:

a: the second conveyer is a screw conveyer having an outer diameter of not less than 24 mm and not more than 30 mm, which rotates with a rotating speed of not less than 300 rpm (revolutions per minute) and not more than 500 rpm, b2: the pickup magnetic pole is arranged at an angle of not less than 40° and not more than 60° downstream with respect to a line connecting a rotation center of the developer carrier and a rotation center of the second conveyer, c: the strip-off magnetic pole is arranged at an angle of not less than 60° and not more than 80° upstream with respect to the line, e: the supply member is arranged above the second conveyer with a distance not less than 1.5 mm and not more than 4.0 mm, f: each of a rotation axis of the second conveyer have an angle $\alpha$ not less than 0.25° and not more than 1.0° with respect to a horizontal line such that a downstream side in the second conveyer transporting direction is positioned higher than the other side.

(5) The image forming apparatus of any one of items (1)-(4), wherein the first conveyer is arranged in an agitation room, and the second conveyer is arranged in a supply/reception room separated from the agitation room with a separator having a developer passing opening.

(6) The image forming apparatus of item (1) or (2), wherein the ratio A/B is not less than 1.07 and not greater than 1.20.

(7) The image forming apparatus of item (2) or (4), wherein the supply member comprises a cylindrical developer carrier for supply, and a magnetic field generating member for supply arranged inside the cylindrical developer carrier for supply.

(8) The image forming apparatus of any one of items (1)-(7), wherein the developer carrier rotates with a linear velocity not less than 350 mm/sec.

(9) The image forming apparatus of any one of items (1)-(8), wherein the developing unit develops the electrostatic latent image with using a magnetic carrier having a volume average of particle diameter not less than 20 μm and not more than 60 μm, and a toner having a volume average of particle diameter not less than 3 μm and not more than 7 μm.

According to any of the embodiment of items (1), (2), (5)-(9), since the transporting capability of the first conveyer to supply the developer to the developer carrier is made larger than the transporting capability of the second conveyer, in addition to that the transporting capability of the second conveyer is made sufficiently high, the developer supply to the developing carrier is performed uniformly in the rotation direction of the developer carrier without temporal fluctuation. Further by arranging the pickup magnetic pole at 25° through 50° downstream with respect to the line connecting a rotation center of the developer carrier and a rotation center of the second conveyer, and by arranging the strip-off magnetic pole at an angle 60° through 80° upstream with respect to the line, uniform density images are formed, especially images of good density uniformity in the transporting direction and in the transporting width direction are formed, since the adhesion of the developer onto the developer carrier and the stripping-off of the developer from the developer carrier are performed smoothly.

According to any of the embodiment of items (3), (4), (7)-(9), since the transporting capability of the second conveyer is made such that the transporting capability at down stream side of the transporting direction is larger than that of the other side, in addition to that the transporting capability of the second conveyer is made sufficiently high, the problem of insufficient developer at the upstream portion of the second conveyer is solved, the problem being apt to be caused by increasing the transporting capability of the second conveyer. And the developer supply to the developing carrier is performed uniformly in the rotation direction of the developer carrier without temporal fluctuation. Further by arranging the pickup magnetic pole to adhere the developer onto the developer carrier at 25° through 50° downstream with respect to the line connecting a rotation center of the developer carrier and a rotation center of the second conveyer, and by arranging the strip-off magnetic pole at an angle 60° through 80° upstream with respect to the line, uniform density images are formed, especially images of good density uniformity in the transporting direction and in the transporting width direction are formed, since the adhesion of the developer onto the developer carrier and the stripping-off of the developer from the developer carrier are performed smoothly.

According to the embodiment of item (6), high quality images are obtained especially without density variation in the course of continuous image formation, and with uniform density in a single page.

According to the embodiment of item (7), uniform density images are formed, since the supply of the developer onto the developer carrier and the stripping-off of the developer from the developer carrier are performed smoothly.

According to the embodiment of item (8), the image formation of high speed and high image quality is made possible.

According to the embodiment of item (9), images are formed with good image properties such as resolution and gradation reproduction.

While the preferred embodiments of the present invention have been described using specific terms, such description is for illustrative purposes only, and it is to be understood that changes and variations may be made without departing from the spirit or scope of the appended claims.

What is claimed is:

1. An image forming apparatus comprising:

an image forming body;

a latent image forming section to form an electrostatic latent image on the image forming body; and a developing unit to form a toner image by developing the electrostatic latent image, wherein the developing unit comprises:

a developer carrier, arranged to face the image forming body, for transporting developer to a developing area and for forming a developer layer in the developing area by rotation of the developer carrier;

a magnetic field generating member arranged inside the developer carrier;

a restriction member to restrict an amount of the developer to be transported by the developer carrier;

a first conveyer to agitate the developer while transporting the developer in a rotation axis direction of the first conveyer; and a second conveyer to receive the developer transported by the first conveyer and to supply the developer to the developer carrier while transporting the developer in a rotation axis direction of the second conveyer, wherein the magnetic field generating member comprises:

a main magnetic pole for generating a magnetic field to form the developer layer on the developer carrier in the developing area;

a pickup magnetic pole to hold the developer from the second conveyer onto the developer carrier; and a strip-off magnetic pole to strip off the developer having passed through the developing area from the developer carrier, wherein the developing unit satisfies following conditions of a, b, c, and d:

a: the second conveyer is a screw conveyer having an outer diameter of not less than 24 mm and not more than 30 mm, which rotates with a rotating speed of not less than 300 rpm (revolutions per minute) and not more than 500 rpm, b: the pickup magnetic pole is arranged at an angle of not less than 25° and not more than 60° downstream with respect to a line connecting a center of the developer carrier axis and a center of the second conveyer axis, the line being perpendicular to the center of the developer carrier axis, and the developer carrier axis being parallel to the second conveyer axis, c: the strip-off magnetic pole is arranged at an angle of not less than 60° and not more than 80° upstream with respect to the line, d: a transporting capability of the first conveyer is larger than a transporting capability of the second conveyer.

2. The image forming apparatus of claim 1, wherein the developing unit further satisfies following conditions of b1 and d1, b1: the pickup magnetic pole is arranged at an angle of not less than 25° and not more than 50° downstream with respect to the line, d1: a ratio A/B is not less than 1.04 and not greater than 1.20 when the transporting capability of the first conveyer is A and the transporting capability of the second conveyer is B.

3. The image forming apparatus of claim 2, wherein the first conveyer is arranged in an agitation room, and the second conveyer is arranged in a supply/reception room separated from the agitation room with a separator having a developer passing opening.

4. The image forming apparatus of claim 2, wherein the ratio A/B is not less than 1.07 and not greater than 1.20.

5. The image forming apparatus of claim 2, wherein the developer carrier rotates with a linear velocity not less than 350 mm/sec.

6. The image forming apparatus of claim 2, wherein the developing unit develops the electrostatic latent image with using a magnetic carrier having a volume average of particle diameter not less than 20 μm and not more than 60 μm, and a toner having a volume average of particle diameter not less than 3 μm and not more than 7 μm.

7. The image forming apparatus of claim 1, wherein the developing unit further comprises a supply member which receives the developer transported by the second conveyer and supplies the developer to the developer carrier by the rotation of the supply member, and the developing unit satisfies following conditions of b2, d1, and e:

b2: the pickup magnetic pole is arranged at an angle of not less than 40° and not more than 60° downstream with respect to the line, d1: a ratio A/B is not less than 1.04 and not greater than 1.20 when the transporting capability of the first conveyer is A and the transporting capability of the second conveyer is B, e: the supply member is arranged above the second conveyer with a vertical distance not less than 1.5 mm and not more than 4.0 mm.

8. The image forming apparatus of claim 7, wherein the first conveyer is arranged in an agitation room, and the second conveyer is arranged in a supply/reception room separated from the agitation room with a separator having a developer passing opening.

9. The image forming apparatus of claim 7, wherein the ratio A/B is not less than 1.07 and not greater than 1.20.

10. The image forming apparatus of claim 7, wherein the supply member comprises a cylindrical developer carrier for supply, and a magnetic field generating member for supply arranged inside the cylindrical developer carrier for supply.

11. The image forming apparatus of claim 7, wherein the developer carrier rotates with a linear velocity not less than 350 mm/sec.

12. The image forming apparatus of claim 7, wherein the developing unit develops the electrostatic latent image with using a magnetic carrier having a volume average of particle diameter not less than 20 μm and not more than 60 μm, and a toner having a volume average of particle diameter not less than 3 μm and not more than 7 μm.

13. The image forming apparatus of claim 1, wherein the developing unit further satisfies following conditions of b1 and f, b1: the pickup magnetic pole is arranged at an angle of not less than 25° and not more than 50° downstream with respect to the line, d1: a ratio A/B is not less than 1.04 and not greater than 1.20 when the transporting capability of the first conveyer is A and the transporting capability of the second conveyer is B.

f: a rotation axis of the second conveyer has an angle α not less than 0.25° and not more than 100° with respect to a horizontal line such that a downstream side in the second conveyer transporting direction is positioned higher than the other side.

14. The image forming apparatus of claim 1, wherein the developing unit further comprises a supply member which receives the developer transported by the second conveyer and supplies the developer to the developer carrier by the rotation of the supply member, and the developing unit satisfies following conditions of b2, e, and f:

b2: the pickup magnetic pole is arranged at an angle of not less than 40° and not more than 60° downstream with respect to the line, e: the supply member is arranged above the second conveyer with a vertical distance not less than 1.5 mm and not more than 4.0 mm, f: a rotation axis of the second conveyer has an angle α not less than 0.25° and not more than 1.00° with respect to a horizontal line such that a downstream side in the second conveyer transporting direction is positioned higher than the other side.

15. The image forming apparatus of claim 14, wherein the supply member comprises a cylindrical developer carrier for supply, and a magnetic field generating member for supply arranged inside the cylindrical developer carrier for supply.

16. The image forming apparatus of claim 1, wherein the first conveyer is arranged in an agitation room, and the second conveyer is arranged in a supply/reception room separated from the agitation room with a separator having a developer passing opening.

17. The image forming apparatus of claim 1, wherein the developer carrier rotates with a linear velocity not less than 350 mm/sec.

18. The image forming apparatus of claim 1, wherein the developing unit develops the electrostatic latent image with using a magnetic carrier having a volume average of particle diameter not less than 20 μm and not more than 60 μm, and a toner having a volume average of particle diameter not less than 3 μm and not more than 7 μm.

* * * * *